US005575333A

United States Patent [19]

Lirette et al.

[11] Patent Number: 5,575,333

[45] Date of Patent: Nov. 19, 1996

[54] CENTRALIZER

[75] Inventors: Brent J. Lirette; Robert P. Vilyus; James G. Martens; Brad W. Hebert, all of Houma, La.

[73] Assignee: Weatherford U.S., Inc., Houston, Tex.

[21] Appl. No.: 484,171

[22] Filed: Jun. 7, 1995

[51] Int. Cl.[6] ..... E21B 17/10

[52] U.S. Cl. ..... 166/241.1; 166/241.6

[58] Field of Search ..... 166/241.1, 241.4, 166/241.5, 241.6, 241.7, 242.1

[56] References Cited

U.S. PATENT DOCUMENTS

| | | | |
|---|---|---|---|
| 1,812,945 | 7/1931 | Granger | 166/241.1 |
| 2,605,844 | 8/1952 | Clark, Jr. | 166/241.7 |
| 2,665,762 | 1/1954 | Althouse, Jr. | 166/241.7 |
| 2,824,613 | 2/1958 | Baker et al. | 166/241.7 |
| 2,828,824 | 4/1958 | Comstock | 166/241.7 X |
| 2,845,128 | 7/1958 | Clark, Jr. et al. | 166/241.7 X |
| 3,200,884 | 8/1965 | Solum et al. | 166/241.6 |
| 3,978,924 | 9/1976 | Roesner | 166/241.5 |
| 4,011,907 | 3/1977 | Clay | 166/241.7 |
| 4,042,022 | 8/1977 | Wills et al. | 166/241 |
| 4,077,470 | 3/1978 | Dane | 166/244 R |
| 4,088,186 | 5/1978 | Callihan et al. | 166/241.7 |
| 4,133,470 | 1/1979 | Trail | 228/44.1 R |
| 4,363,360 | 12/1982 | Richey | 166/241 |
| 4,523,640 | 6/1985 | Wilson et al. | 166/241.5 X |
| 4,531,582 | 7/1985 | Muse et al. | 166/241 |
| 4,630,690 | 12/1986 | Beasley et al. | 175/57 |
| 4,787,458 | 11/1988 | Langer | 166/380 |
| 4,794,986 | 1/1989 | Langer | 166/241 |
| 4,984,633 | 1/1991 | Langer et al. | 166/241 |
| 5,095,981 | 3/1992 | Mikolajczyk | 166/241.6 |
| 5,238,062 | 8/1993 | Reinholdt | 166/241.7 |
| 5,261,488 | 11/1993 | Gullet et al. | 166/241.7 |

OTHER PUBLICATIONS

Applied Drilling Engineering, Bourgoyne Jr. et al. (Table 7.6).

Petroleum Engineering, Gatlin (Table 14.11).

"Weatherford General Catalog," Weatherford International, 1992, particularly pp. 1, 11–14, 20.

"Laboratory Drill Pipe Protector Tests," Ed. J. P. Vozniak, vol. 56 Drilling Technology, 1994.

"API Specification For Casing Centralizers," American Petroleum Institute, 1986.

"Bakerline Float Equipment & Cementing Aids," Baker Packers Div. of Baker Oil Tools, Inc. 1984, pp. 17, 18, 19, 20.

"1982–1983 Catalog," Trico Industries, Inc., 1982, pp. 8222, 8223, 8224.

"Proven Primary Cementing Tools," Antelope Oil Tools, Frank's International, 1993.

*Primary Examiner*—Frank Tsay

*Attorney, Agent, or Firm*—Guy McClung

[57] ABSTRACT

A centralizer apparatus has been developed which, in one aspect, has a tubular body with an exterior surface, a collar movably emplaced around the tubular body and movable longitudinally thereon, a plurality of spring bows, each spring bow having a first end spaced apart from a second end, each spring bow biased outwardly from the tubular body, the first ends connected to the tubular body, the second ends connected to the first collar, so that upon movement of the first collar the spring bows move toward the tubular body. In one aspect the collar is connected to bottom ends of the spring bows and is initially movable to abut a stop on the tubular body so that from that point on the spring bows are pulled into another tubular, e.g. casing, as the centralizer apparatus moves down into the casing. In another embodiment two movable collars are used, one at each end of the spring bows.

16 Claims, 7 Drawing Sheets

FIG. 9a
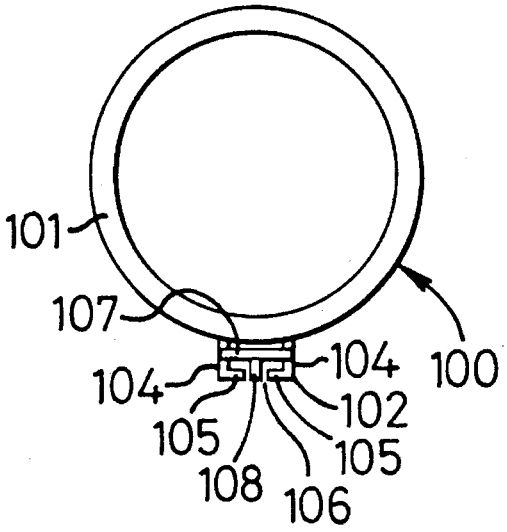
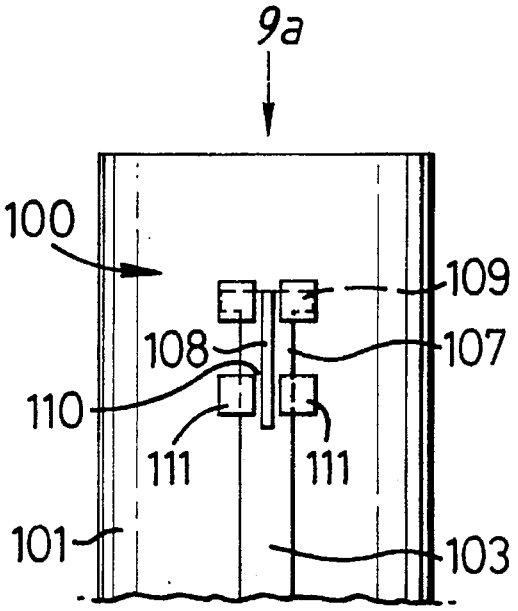
FIG. 9b
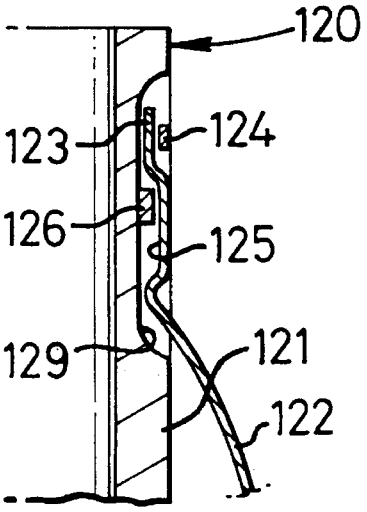
FIG. 10a
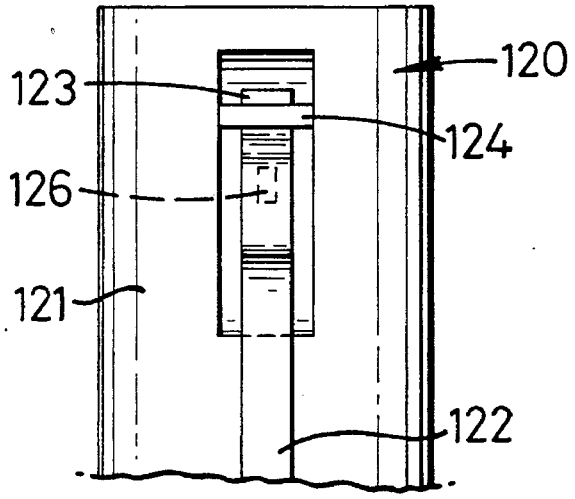
FIG. 10b

CENTRALIZER

BACKGROUND OF THE INVENTION

1. Field of the Invention

This invention is directed to centralizers for use in wellbore operations; and, in one particular aspect to centralizers with movable spring bows, particularly such centralizers which can be used in a relatively small annular space and which can expand in a larger annular space.

2. Description of Related Art

Bowspring centralizers are used to center one tubular member inside a borehole or in another tubular member, e.g. to center a first smaller casing in a second larger casing. Typically centralizers are placed on the exterior of an inner casing and project outwardly therefrom. In many typical situations the annular space between the outer circumference of the smaller casing and the inner circumference of the larger casing is sufficiently large that, with some force, a centralizer on the inner first casing can be moved into the interior of the second outer casing. The centralizer will present some fluid flow restriction in the annular space.

In a variety of situations the annular space is relatively small and it is difficult or impossible to use conventional multi-spring bow centralizers or conventional rigid centralizers. Attempts have been made to fabricate an apparatus from a tubular member with vanes welded on or milled into the tubular to provide standoff of the inner casing from the outer casing, or, in another aspect, standoff of the casing from a wellbore's interior. One such device provides standoff of casing from a wellbore equal to half the difference between vane outside diameter and casing outside diameter. In some situations these apparatuses do not achieve sufficient standoff, e.g. when a wellbore is underreamed or "washed out" to a significantly larger diameter so that the vanes (or bows) have significantly reduced standoff and/or reduced contact with the wellbore interior.

The present inventors have recognized the problems mentioned above and have recognized that it would be very desirable to have a centralizer which is usable in a relatively small annular space and yet which has the ability to function in a larger annular space.

SUMMARY OF THE PRESENT INVENTION

The present invention, in one aspect, discloses a centralizer apparatus which has a body comprising a tubular member with a longitudinal bore therethrough along its length; one or more circumferential grooves formed or milled in an exterior surface of the body; a collar movably disposed in the groove or grooves; and a plurality of spring bows fixed to or movably secured to a first collar and a second collar spaced apart from the first collar.

At least one collar is longitudinally movable in its corresponding groove and has a degree of freedom of movement in the groove which permits the spring bows (which are normally naturally biased to spring away from the tubular member) to collapse toward the tubular member when forced inwardly by contact with the interior of a wellbore or of a second tubular member. In certain embodiments, the groove or grooves are of sufficient depth and the degree of movement is such that the collar and spring bows are movable to allow the spring bows to lie flat against the tubular body and, in one aspect, within recesses or grooves therein.

In certain embodiments only one movable collar is employed and the spring bows are secured either to the tubular member itself or to a collar which is also immovably or relatively immovably affixed to the tubular member. In another aspect each of a plurality of spring bows has a first end secured to the tubular member and a second end which is not fixed to the tubular member and is free to move longitudinally with respect to the tubular member. In one such embodiment one or both spring bow ends may be disposed wholly or partially in a corresponding recess in the exterior surface of the tubular member or in a slot through a portion of the tubular member. In one aspect such a groove or recess may extend on the tubular member along the entire length of the spring bow so that a major portion of the spring bow may repose in the recess or groove when it is collapsed toward the tubular member.

In certain embodiments one or both ends of a spring bow are movably held on a collar so that the spring bow end, and hence the spring bow itself, is movable with respect to the collar. The collar may be fixed to the tubular member or movable on the tubular member. Any collar described herein may be movable in a groove or recess extending around a tubular member or it may be emplaced around the tubular member's exterior without the use of a groove or recess. Collars may be emplaced around a tubular body in two pieces which are then secured together, e.g. by welding and/or with connection pins or screws; or a one piece collar with a gap between its ends may be placed around a tubular body and then the ends are welded together.

In certain embodiments the tubular member is a piece of casing like the other casing in a first casing string which is to be centered within a second casing string or a wellbore. In another embodiment the tubular member is a piece of tubing which is used as part of a tubing string employed in a larger tubing or casing string. Such a piece of casing or tubing used as the tubular member may have threaded ends to facilitate its insertion into a casing string or tubing string and mating with other pieces of casing or tubing on either end thereof.

Centralizers and/or any or all parts thereof according to this invention may be made of any suitable material, including, but not limited to, metal, plastic, fiberglass, composites, cermets, aluminum, aluminum alloys, brass, copper, zinc, or zinc alloys.

In certain embodiments which have a lower movable collar, the collar is movable upon contact of the spring bows, e.g. by contacting a slightly larger casing into which the centralizer apparatus is being inserted, so that the movable collar is pushed up against a stop or a top side wall of a groove in which it is disposed. Since the collar can no longer move on the tubular member the spring bows are pulled into the larger casing due to the downward movement of the entire centralizer apparatus. At the same time the end of the larger casing is forcing the spring bows inwardly and, if a movable upper collar is used, the movable upper collar is moving upwardly in its groove while the spring bows are moving toward and/or to contact the tubular body.

It is, therefore, an object of at least certain preferred embodiments of the present invention to provide:

New, useful, unique, efficient, nonobvious devices and methods for centralizing one tubular member in another or in a wellbore;

Another object of the present invention is to provide centralizer apparatus useful in a relatively small annular space between two tubular members or between a tubular member and a wellbore;

Another object of the present invention is the provision of such centralizer apparatus in which spring bows of the apparatus may move so that the apparatus is movable into or through a tubular member which is not much larger in inner diameter than the centralizer apparatus is in outer diameter;

Another object of the present invention is the provision of a centralizer apparatus in which lower ends of spring bows are immobile or are held immobile so that in effect the spring bows are pulled into a wellbore or into a larger tubular into which the centralizer apparatus is being inserted;

Another object of the present invention is the provision of such centralizer apparatus in which some or all of a spring bow is collapsible into a slot, groove or recess in or on the tubular member; and Another object of the present invention is the provision of a centralizer apparatus with two spaced apart collars movably emplaced on a tubular body with a plurality of outwardly-biased spring bows extending between and secured to the collars; the collars movable in grooves or recesses on the tubular body and at least a portion of the spring bows collapsible into recesses on the tubular body or into slots therein.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 9*a* is an end view of a centralizer according to the present invention. FIG. 9*b* is a partial side view of the centralizer of FIG. 9*a*.

FIG. 10*a* is a partial side view of a centralizer according to the present invention. FIG. 10*b* is a partial side view of the centralizer of FIG. 10*a*.

DESCRIPTION OF EMBODIMENTS PREFERRED AT THE TIME OF FILING FOR THIS PATENT

Figure 1A:
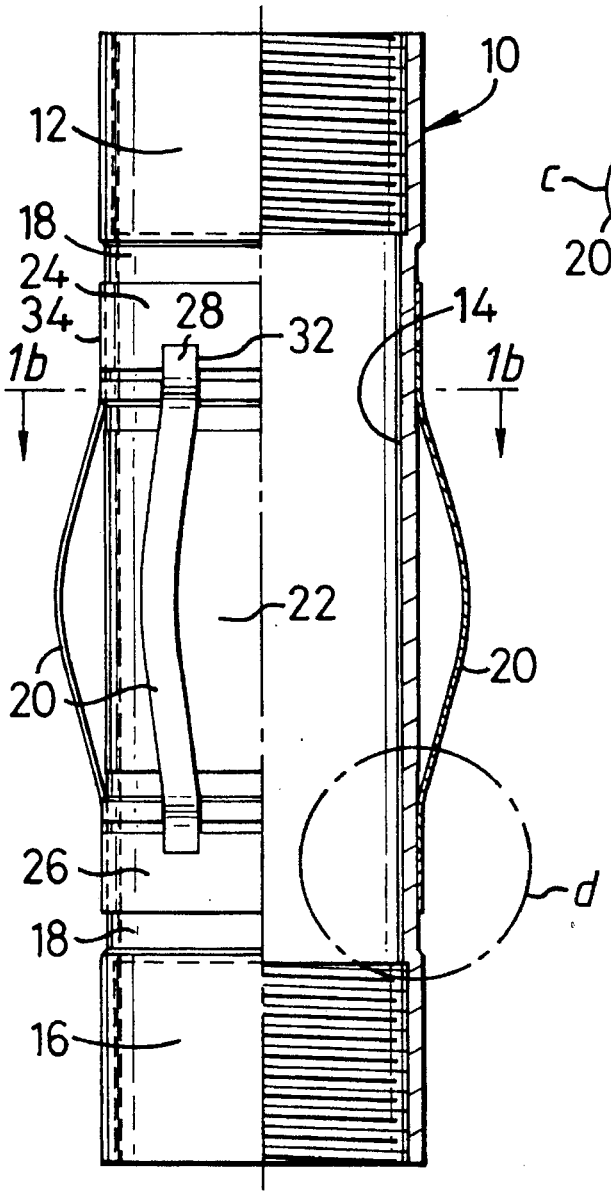
FIG. 1*a* is a side view, partially in cross-section, of a centralizer according to the present invention.
Figure 1B:
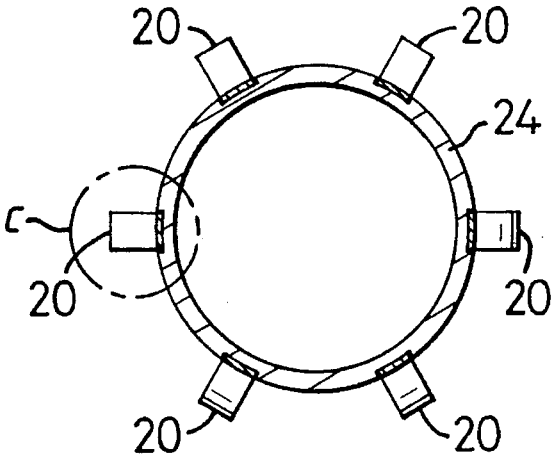
FIG. 1*b* is a cross-sectional view along line 1*b*—1*b* of FIG. 1*a*.

A centralizer 10 according to the present invention as shown in FIG. 1*a* has a tubular body 12 with a central longitudinal bore 14 running therethrough. In certain aspects the tubular body 12 is a piece of casing or tubing. Formed in or machined into an exterior surface 16 of the tubular body 12 are two collar grooves 18 and a spring bow groove 22.

Figure 1C:
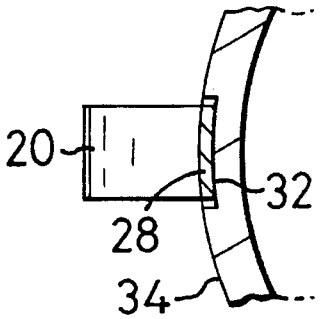
FIG. 1*c* is an enlargement of the detail of circle c in FIG. 1*b*.
Figure 1D:
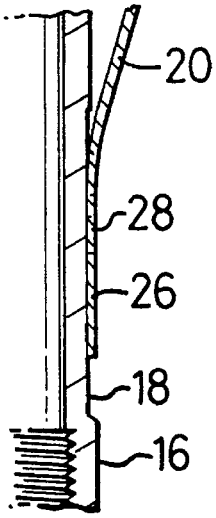
FIG. 1*d* is an enlargement of the detail of circle d in FIG. 1*a*.

A first collar 24 is movably disposed in the top collar groove 18 and a second collar 26 is movably disposed in the bottom collar groove 18. A plurality of spring bows 20 are spaced apart around the collars 24, 26 with opposing ends secured to each collar. Preferably each spring bow end (like the spring bow end 28, FIG. 1*c*) is disposed in a groove 32 in one of the collars so that all or substantially all of the spring bow ends do not extend beyond an outer surface 34 of the collars.

Figure 1E:
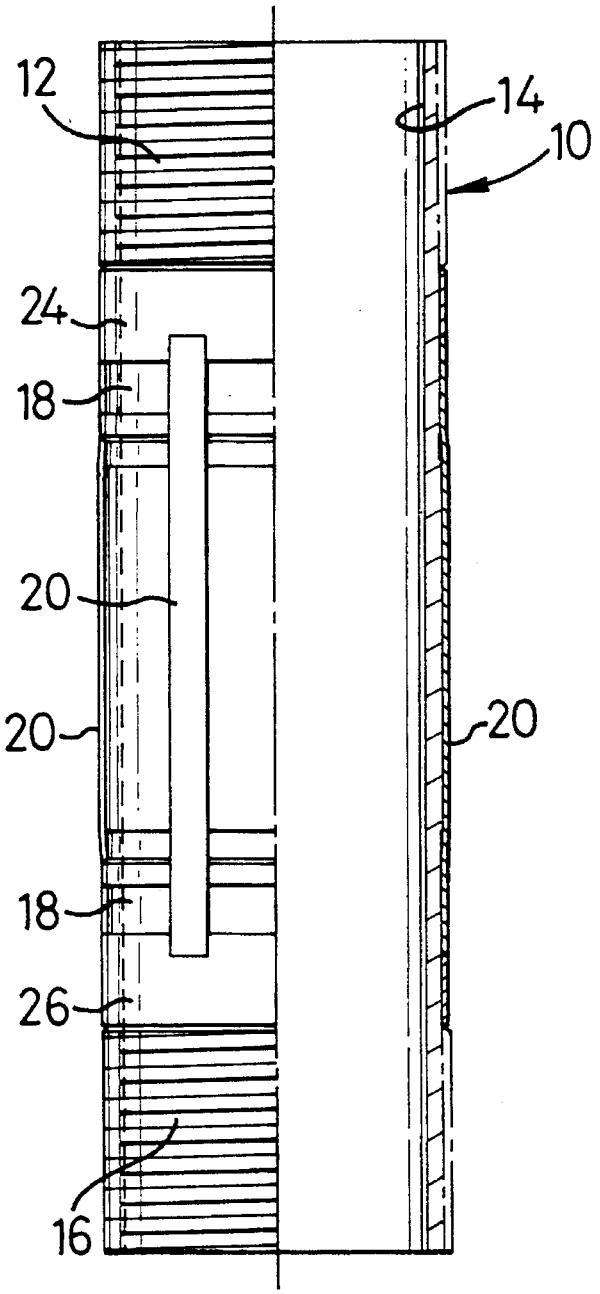
FIG. 1*e* is a side view, partially in cross-section, of the centralizer of FIG. 1*a*.

As shown in FIG. 1*e*, the two collars 24, 26 have moved apart from each other in their respective collar grooves 18; and the spring bows 20 have collapsed with a major portion thereof in the groove 22. A bottom ridge 23 provides a stop which abuts the lower collar 26 when it has moved in response to spring bow contact with another member, e.g. a slightly larger casing. Once such abutment occurs, the spring bows are pulled into the larger casing as the centralizer is moved downwardly into the larger casing.

Figure 3A:
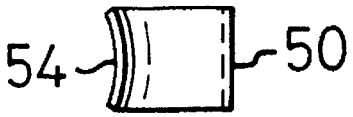
FIG. 3*a* is an end view of a spring bow.
Figure 3B:
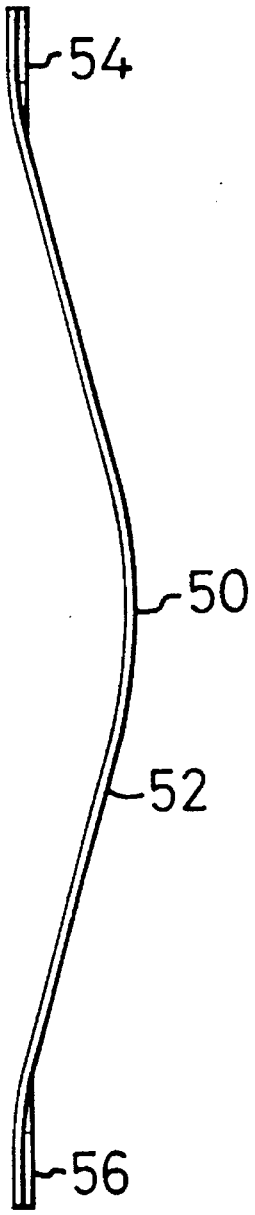
FIG. 3*b* is a side view of the spring bow of FIG. 3*a*.

FIG. 3*b* shows a spring bow 50 with a body 52 and ends 54, 56. FIG. 3*a* shows the end 54 (like the end 56) which has a curved shape to accommodate the curved exterior surface 16 of the tubular body 12. The curved shape also permits the ends 54, 56 to "hug" the exterior surface 16 reducing the extent to which the ends would project beyond the surface 16. The spring bows 20 may have non-curved ends or they may be like the spring bow 50.

Figure 4:
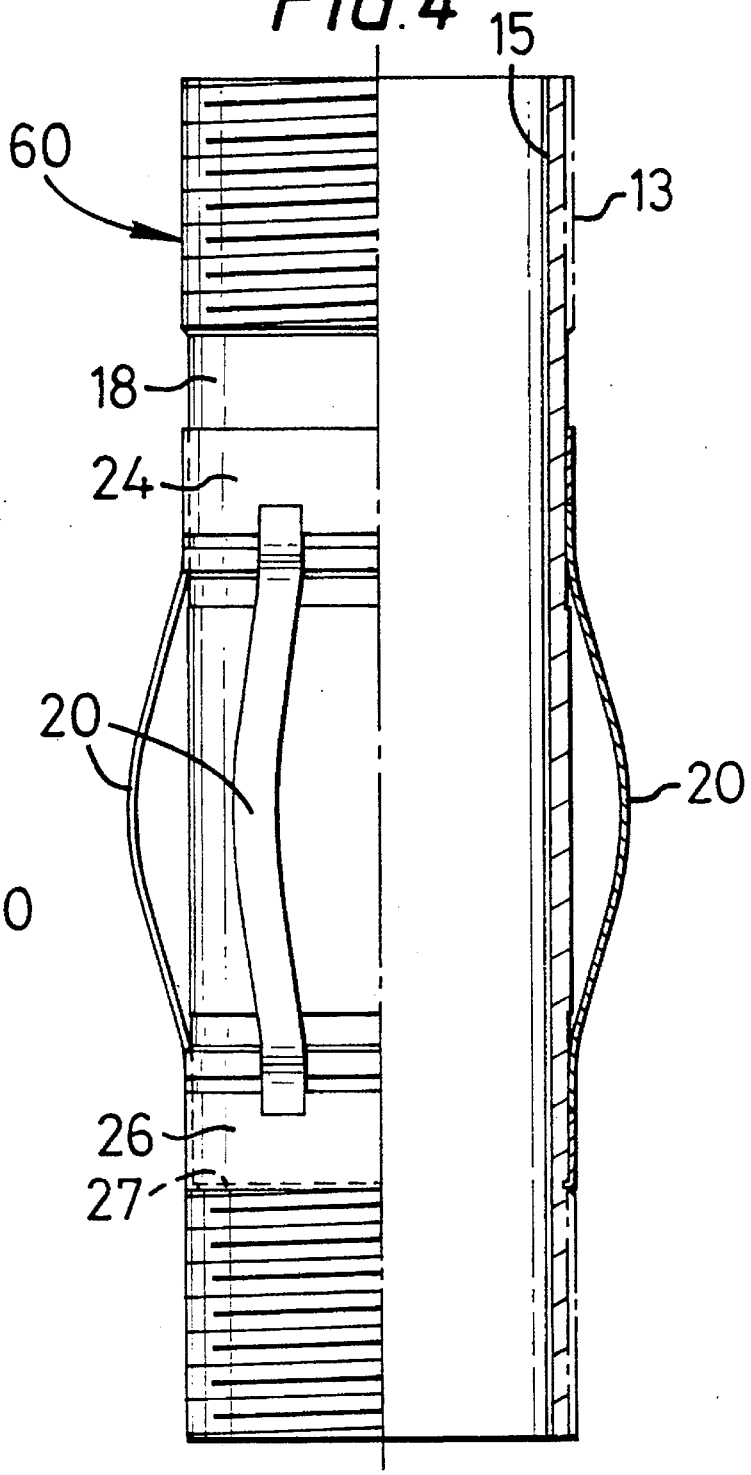
FIG. 4 is a side view, partially in cross-section, of a centralizer according to the present invention.

FIG. 4 illustrates a centralizer 60 according to the present invention which is like the centralizer 10 (with like numerals indicating similar parts); but the centralizer 60 has only one collar groove 18 and only one movable collar 24. The lower collar 26 may be in a groove 27 in which it does not move or it may be fixed around a tubular body 13 of the centralizer 60. The tubular body 13 (like the tubular body 12) has a bore 15 (like the bore 14) therethrough. Upon movement of the collar 24, the spring bows 20 can move toward and collapse against an exterior surface of the tubular body 13.

Figure 5:
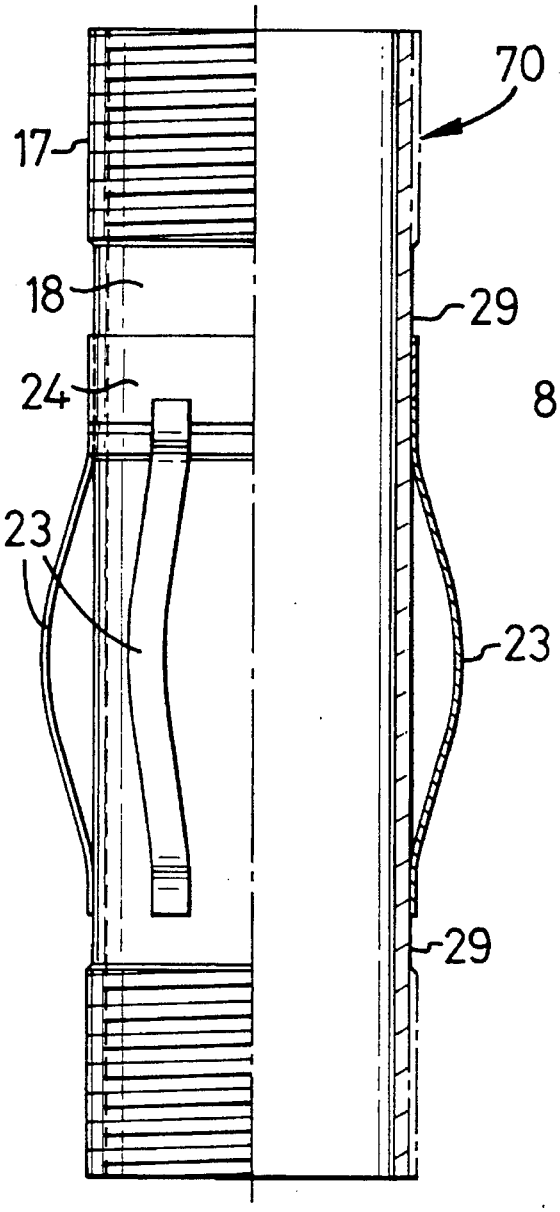
FIG. 5 is a side view, partially in cross-section, of a centralizer according to the present invention.

FIG. 5 illustrates a centralizer 70 according to the present invention (in which parts similar to those of centralizer 10 bear the same identifying numerals) with one movable collar 24 movable in a collar groove 18. Ends 21 of spring bows 23 (like the spring bows 20) are secured to a tubular body 17 of the centralizer 70, e.g. by welding. Upon movement of the collar 24, the spring bows 23 can move toward and collapse against an exterior surface of the tubular body 17. A groove or recess 29 may be provided to receive the spring bows when they collapse.

Figure 6:
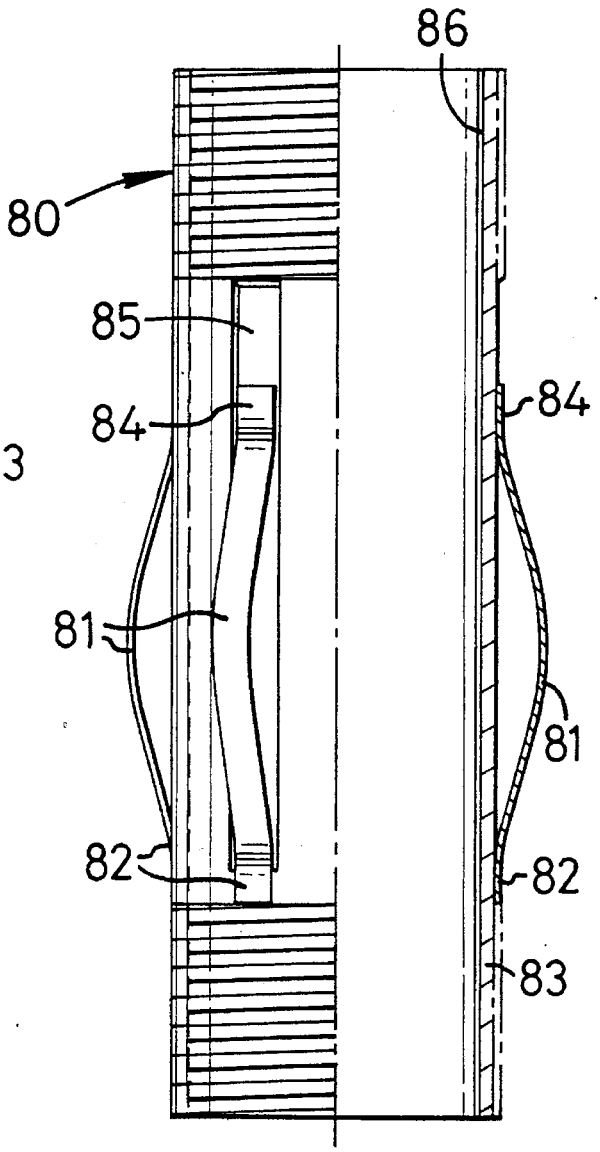
FIG. 6 is a side view, partially in cross-section, of a centralizer according to the present invention.

FIG. 6 illustrates a centralizer 80 according to the present invention. A plurality of spring bows 81 have a first end 82 secured to a tubular body 83 of the centralizer 80. A second end 84 of each spring bow 81 is receivable in and movable in a groove 85 formed in or milled in the tubular body 83. A bore 86 extends through the body 83. Upon contact of the spring bows 81 with an interior of another tubular or a wellbore, the spring bows move toward the tubular body 83 with their ends 84 moving in the grooves 85 so that the spring bows collapse against the tubular body 83.

Figure 7A:
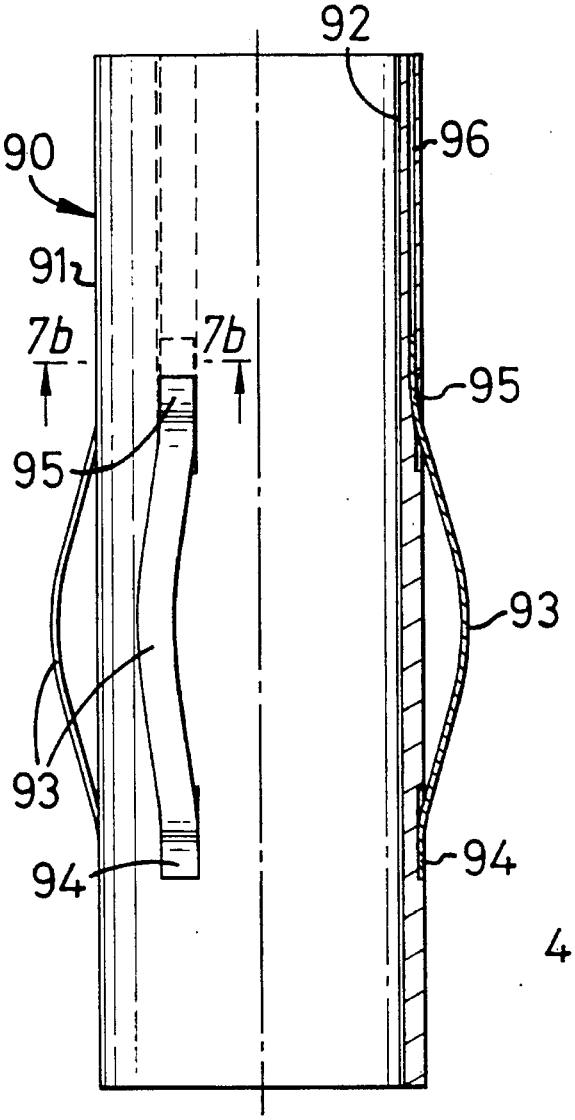
FIG. 7 is a side view, partially in cross-section, of a centralizer according to the present invention.
FIG. 7*b* is a partial cross-section view along line 7*b*—7*b* of FIG. 7*a*.
Figure 7B:
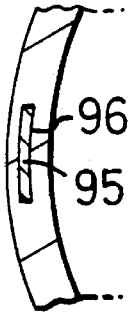

FIGS. 7*a* and 7*b* illustrate a centralizer 90 according to the present invention which has a tubular body 91 with a bore 92 therethrough. A plurality of spring bows 93 each has an end 94 secured to the tubular body 91 and an end 95 freely movable in a slot 96 extending through a portion of the tubular body 91. A groove or recess may be used beneath each spring bow to receive some, a major portion of, or all of it upon collapse of the spring bows against the tubular body.

Figure 8:
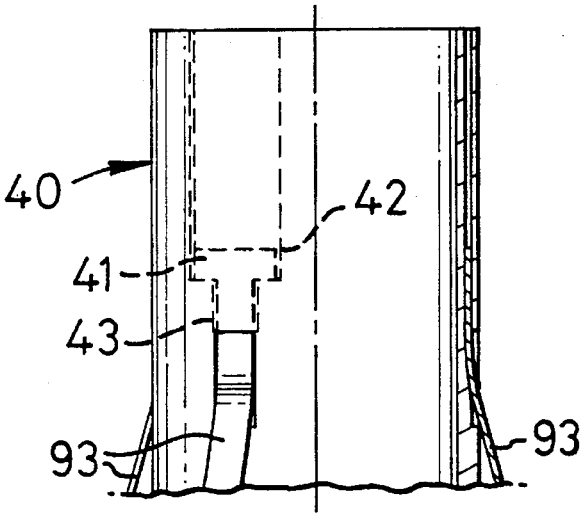
FIG. 8 is a side view, partially in cross-section, of a centralizer according to the present invention.

FIG. 8 shows a centralizer 40 like the centralizer 90; (and like aspects bear like identifying numerals); but the spring bows 93 have a tab end 41 which is movable in an enlarged portion 42 of a slot 43. It is within the scope of this invention to provide a tab 41 and a slot 43 for the opposing spring bow ends. Such a tab end and enlarged groove portion may be used with the ends 84 of the spring bows 81 in the centralizer 80 of FIG. 6. In one aspect the tab end may be a piece which is initially separate from the spring bow, but which is secured to a spring bow end (e.g. by welding, screws, or bolts) once the spring bow end is inserted into and through a slot.

It is within the scope of this invention to provide structures which project beyond the exterior surface of a centralizer body and confine a spring bow end with the spring bow end movable in the structure so that the spring bow can collapse. Alternatively such a structure may be provided on a collar that is fixed (movably or immovably) around a centralizer body or around a groove in a centralizer body.

FIGS. 9*a* and 9*b* show a centralizer 100 according to the present invention with a tubular hollow body 101 and one or more spring bow end retainers 102 and a spring bow 103. Any number of spring bow retainers 102 and spring bows 103 may be used spaced apart around the outer circumference of the tubular hollow body 101. The retainer 102 has two upright arms 104, each with a shoulder 105, and with a gap 106 between them. A lower portion 107 of the spring bow 103 is movably confined beneath the shoulders 105 and an upwardly extending portion 108 moves in the gap 106. An end 109 of the spring bow is larger than a space 110 between two stop members 111, thus preventing the spring bow from falling off of the tubular body 101.

FIGS. 10*a* and 10*b* show a centralizer 120 with a tubular body 121 and one (or more) spring bows 122. An end 123 of the spring bow 122 is movably disposed under a bar 124 which holds the spring bow end and prevents it from falling away from the tubular body 121. An arch 125 in the spring bow end moves over a stop member 126, e.g. when the spring bow moves inwardly to collapse against the tubular body 121. In preferred embodiment the various parts, grooves, recesses, etc. are sized, disposed and configured to permit full collapse of the spring bow(s) against and/or into the tubular body (as with all embodiments described and claimed herein). The spring bow end moves in a recess 129. The spring bows of the apparatuses of FIGS. 9*a* and 10*a* may have tab ends like those of the apparatus of FIG. 8.

Figure 11:
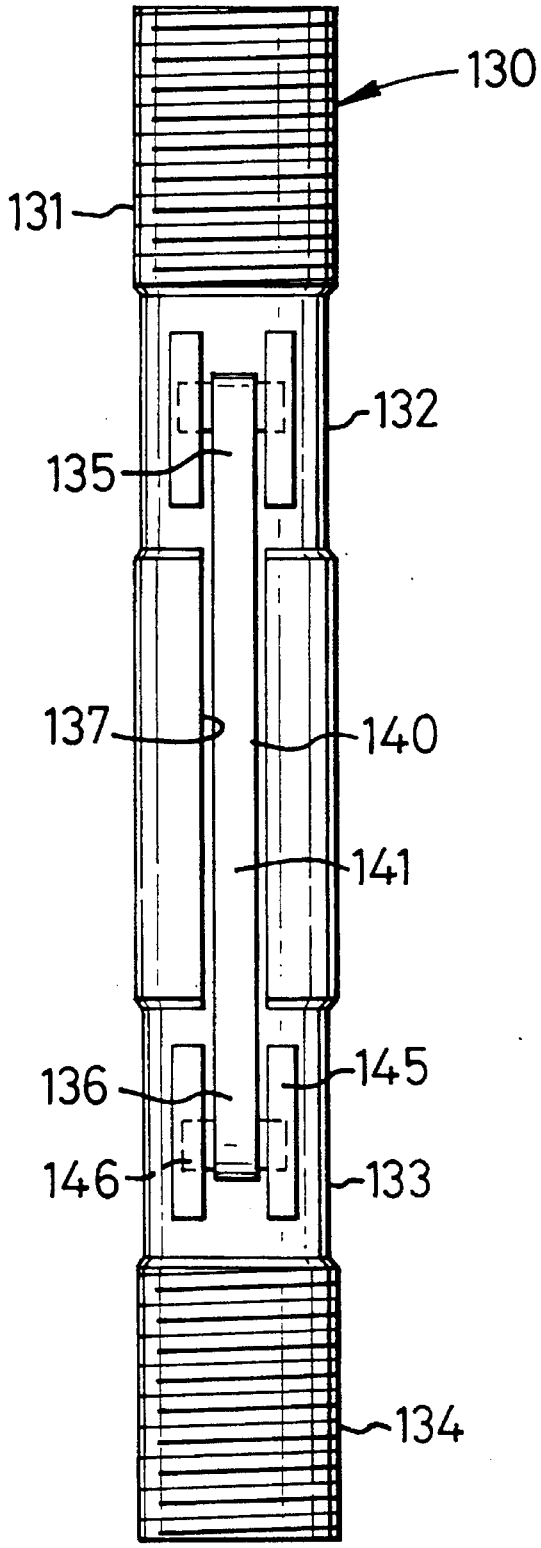
FIG. 11 is a side view of a centralizer according to the present invention.

FIG. 11 shows a centralizer 130 with a hollow tubular body 131. A top end groove 132 and a bottom end groove 133 are formed of or milled or machined into an outer surface 134 of the hollow tubular body 131. The end grooves are sized and configured to permit ends 135 and 136 of a spring bow 140 to move therein so that a body 141 of the spring body 140 may move into a longitudinal groove 137 in the outer surface 134 when the spring bow 140 collapses toward the hollow tubular body 131. Retainers 145 (like the retainers 102, FIG. 9*a*) hold tab ends 146 of the spring bow 140 as they move within the retainers 145.

Figure 2:
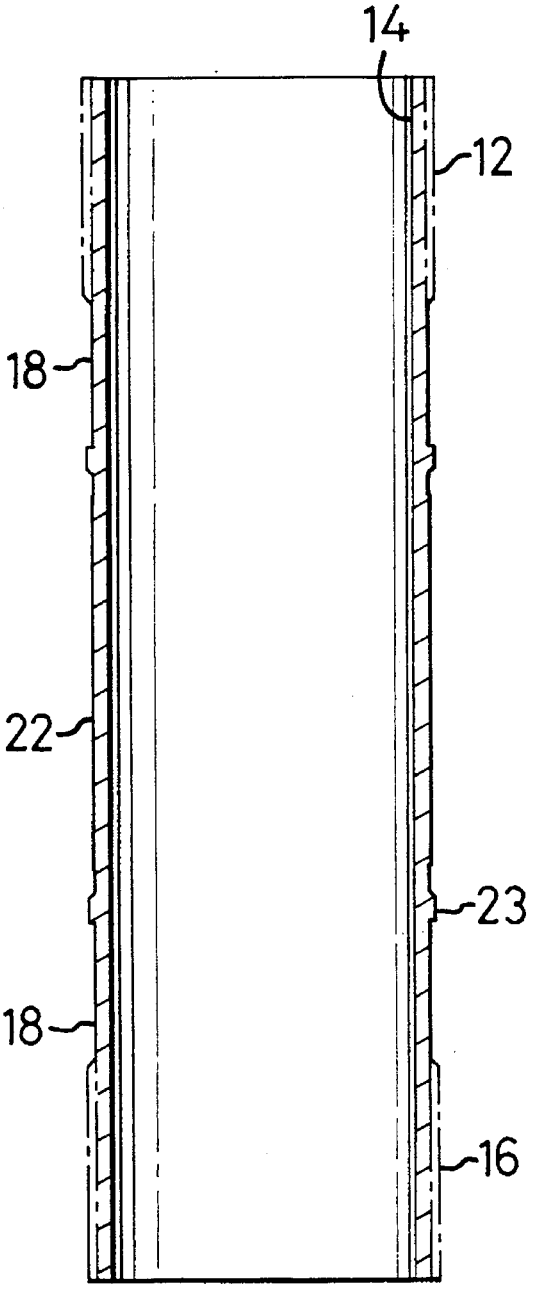
FIG. 2 is a side cross-section view of a tubular body of the centralizer of FIG. 1*a*.
Figure 12:
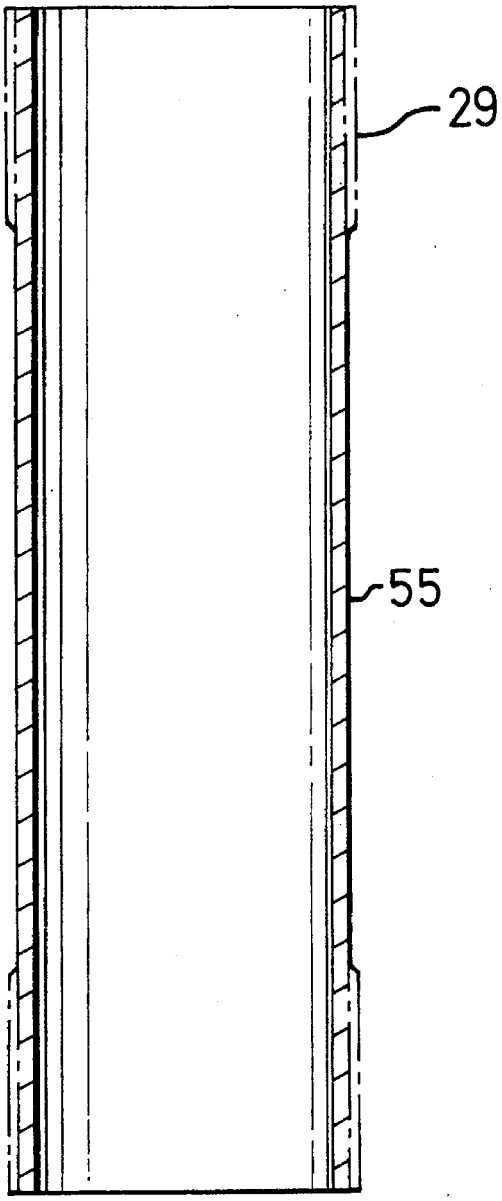
FIG. 12 is a side view in cross-section of a tubular body for a centralizer according to the present invention.

FIG. 12 illustrates a tubular body 29 (like the tubular body 12, FIG. 2); but which has only one large groove 55 therearound for accommodating two movable collars (like, e.g., collars 24, 26, FIG. 1*a*) and the spring bows. In any embodiment of this invention the tubular body may be solid or it may have a fluid flow bore or bores therethrough.

In certain embodiments of the present invention it is preferred that the parts, grooves, and recesses are sized, configured, and disposed so that the collars and spring bows, upon collapse of the spring bows against the apparatuses tubular body, do not project beyond the tubular body's exterior surface more than three-eighths of an inch. In other embodiments this preferred length is no more than one-fourth inch; one-eighth inch; one-sixteenth inch; or zero. In other embodiments the collars and spring bows are within grooves, recesses, etc. and are below the top level of the tubular body's exterior surface.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A centralizer apparatus comprising a tubular body with an exterior surface, a first collar movably emplaced around the tubular body and movable longitudinally thereon, a first groove in the exterior surface of the tubular body, the groove defined by a top side wall, a bottom side wall, and a middle wall therebetween, the first collar movably disposed in the groove, and the first groove top side wall and bottom side wall limiting first collar movement, a plurality of spring bows, each spring bow having a first end spaced apart from a second end, each spring bow biased outwardly from the tubular body, the first ends connected to the first collar, so that upon movement of the first collar in a direction away from the second ends of the spring bows the first ends move with the first collar and the spring bows move inwardly toward the tubular body.

2. The centralizer apparatus of claim 1 further comprising a second collar movably emplaced around the tubular body and movable longitudinally thereon, the second ends of the spring bows connected to the second collar, so that upon movement of the second collar in a direction away from the first ends of the spring bows the second ends of the spring bows move with the second collar and the spring bows move inwardly toward the tubular body, a second groove in the exterior surface of the tubular body, the second groove defined by a top side wall and a bottom side wall, and a middle wall therebetween, the second collar movably disposed in the second groove, and the second groove top side wall and bottom side wall limiting second collar movement.

3. The centralizer apparatus of claim 2 further comprising a spring bow recess in the exterior surface of the tubular body beneath each spring bow for receiving a portion of each spring bow.

4. The centralizer apparatus of claim 3 wherein an exterior surface of the tubular body has a top level and the centralizer apparatus further comprising the first collar at or below the top level of the exterior surface of the tubular body, and a major portion of the spring bows receivable in the spring recesses and disposable therein at or below the top level of the exterior surface of the tubular body.

5. The centralizer apparatus of claim 2 wherein the exterior surface of the tubular body has a top level and the centralizer apparatus further comprising the second collar at or below the top level of the exterior surface of the tubular body, and a major portion of the spring bows receivable in the spring recesses and disposable therein at or below the top level of the exterior surface of the tubular body.

6. The centralizer apparatus of claim 2 further comprising the second collar releasably emplaced around the tubular body.

7. The centralizer apparatus of claim 1 further comprising the tubular body is hollow with a bore extending longitudinally therethrough.

8. The centralizer apparatus of claim 1 wherein the second ends of the spring bows are secured to a second collar which is immovably secured to the tubular body.

9. The centralizer apparatus of claim 1 further comprising the first collar releasably emplaced around the tubular body.

10. The centralizer apparatus of claim 1 further comprising the second ends of the spring bows immovably secured to the tubular body.

11. A centralizer apparatus comprising a hollow tubular body with an exterior surface and a longitudinal bore therethrough, a first collar movably emplaced around the tubular body and movable longitudinally thereon, a plurality of spring bows, each spring bow having a first end spaced apart from a second end, each spring bow biased outwardly from the tubular body, a first groove in the exterior surface of the tubular body, the groove defined by a top side wall and a bottom side wall, and a middle wall therebetween, the first collar movably disposed in the groove, the first groove top side wall and bottom side wall limiting first collar movement, the first ends of the spring bows connected to the first collar, so that upon movement of the first collar in a direction away from the second ends of the spring bows the spring bows move inwardly toward the tubular body, a second collar movably emplaced around the tubular body and movable longitudinally thereon, the second ends of the spring bows connected to the second collar, so that upon movement of the second collar away from the first collar, the spring bows move inwardly toward the tubular body, a second groove in the exterior surface of the tubular body, the second groove defined by a top side wall and a bottom side wall, and a middle wall therebetween, the second collar movably disposed in the groove, and the second groove top side wall and bottom side wall limiting second collar movement.

12. The centralizer apparatus of claim 11 wherein the first ends of the spring bows are below the second ends of the spring bows so that the centralizer apparatus is pullable into a hollow tubular member upon downward movement of the centralizer apparatus toward and into the hollow tubular member.

13. A centralizer apparatus comprising a tubular body with an exterior surface, and a plurality of spring bows, each spring bow in an initial position and having a first end spaced apart from a second end, each spring bow biased outwardly from the tubular body, the first ends secured to the tubular body, the second ends movable with respect to the tubular body and, the second ends spaced apart from and not interconnected with each other.

14. The centralizer apparatus of claim 13 further comprising the spring bows movable inwardly toward the tubular body by contact with an upper edge or an inner surface of a hollow tubular member, and upon movement of the centralizer apparatus through the hollow tubular member and upon exiting therefrom and cessation of contact with the hollow tubular member and release of the spring bows therefrom, the spring bows expand outwardly and move outwardly away from the tubular body back to the initial position.

15. The centralizer apparatus of claim 14 further comprising a spring bow recess in the tubular body for receiving a portion of each spring bow as each spring bow moves inwardly toward the tubular body.

16. The centralizer apparatus of claim 13 further comprising retainer apparatus on the tubular body for holding the spring bow second ends and guiding their movement.

* * * * *

US005575333C1

(12) EX PARTE REEXAMINATION CERTIFICATE (6019th)

United States Patent

Lirette et al.

(10) Number: US 5,575,333 C1

(45) Certificate Issued: Nov. 27, 2007

(54) CENTRALIZER

(75) Inventors: Brent J. Lirette, Houma, LA (US); Robert P. Vilyus, Houma, LA (US); James G. Martens, Houma, LA (US); Brad W. Hebert, Houma, LA (US)

(73) Assignee: Weatherford/Lamb, Inc., Houston, TX (US)

Reexamination Request:
No. 90/007,870, Jan. 10, 2006
No. 90/008,117, Jul. 20, 2006

Reexamination Certificate for:

| | |
|---|---|
| Patent No.: | **5,575,333** |
| Issued: | **Nov. 19, 1996** |
| Appl. No.: | **08/484,171** |
| Filed: | **Jun. 7, 1995** |

(51) Int. Cl.
*E21B 17/10* (2006.01)

(52) U.S. Cl. ..... 166/241.1; 166/241.6

(58) Field of Classification Search ..... None
See application file for complete search history.

(56) References Cited

U.S. PATENT DOCUMENTS

| | | | | |
|---|---|---|---|---|
| 350,655 A | | 10/1886 | Brooder et al. | |
| 480,926 A | | 8/1892 | Hoadley | |
| 1,170,737 A | | 2/1916 | Clark | |
| 1,314,070 A | | 8/1919 | McKissick | |
| 1,565,518 A | | 6/1925 | Smyser | |
| 1,767,198 A | | 6/1930 | Baker | |
| 1,775,376 A | * | 9/1930 | Steps et al. | 166/241.6 |
| 1,812,945 A | | 7/1931 | Granger | |
| 1,998,833 A | * | 4/1935 | Crowell | 166/194 |
| 2,058,310 A | * | 10/1936 | Hartman et al. | 166/241.6 |
| 2,068,704 A | | 1/1937 | Powell | |
| 2,089,553 A | * | 8/1937 | Hartman et al. | 166/241.6 |
| 2,258,052 A | | 10/1941 | Hall | 166/18 |
| 2,546,582 A | | 3/1951 | Baker | 166/4 |
| 2,605,844 A | | 8/1952 | Clark, Jr. | |

(Continued)

FOREIGN PATENT DOCUMENTS

| | | | |
|---|---|---|---|
| DE | G 89 03 038.9 | | 5/1989 |
| GB | 682489 | | 11/1952 |
| GB | 689807 | | 4/1953 |
| GB | 1030706 | * | 5/1966 |
| GB | 2249333 | | 5/1992 |
| GB | 2366580 | | 3/2002 |

OTHER PUBLICATIONS

Civil Docket for Case #:4:03–cv–05383 (U.S. District Court, Southern District of Texas) (pp. 1–14).
Original Complaint, Nov. 24, 2003 [1].
CaseTech's Answer and Counterclaims, Dec. 15, 2003 [3].
CaseTech's Answer and Counterclaims, Dec. 22, 2003 [5].
CaseTech's Answer and Counterclaims, Dec. 22, 2003 [6].
Weatherford International, Inc.'s and Weatherford/Lamb, Inc.'s Answers to CaseTech's Counterclaims, Jan. 7, 2004 [10].

(Continued)

*Primary Examiner*—Bibhu Mohanty

(57) ABSTRACT

A centralizer apparatus has been developed which, in one aspect, has a tubular body with an exterior surface, a collar movably emplaced around the tubular body and movable longitudinally thereon, a plurality of spring bows, each spring bow having a first end spaced apart from a second end, each spring bow biased outwardly from the tubular body, the first ends connected to the tubular body, the second ends connected to the first collar, so that upon movement of the first collar the spring bows move toward the tubular body. In one aspect the collar is connected to bottom ends of the spring bows and is initially movable to abut a stop on the tubular body so that from that point on the spring bows are pulled into another tubular, e.g. casing, as the centralizer apparatus moves down into the casing. In another embodiment two movable collars are used, one at each end of the spring bows.

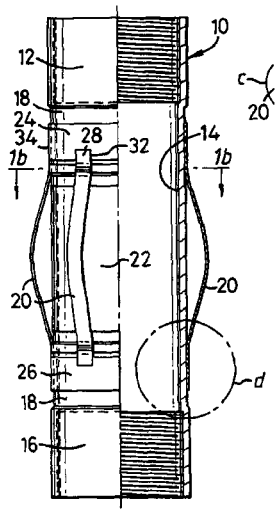

U.S. PATENT DOCUMENTS

| | | | | |
|---|---|---|---|---|
| 2,628,682 | A | 2/1953 | Wright | 166/18 |
| 2,640,544 | A | 6/1953 | Baker | 166/4 |
| 2,654,435 | A | 10/1953 | Oliver | |
| 2,665,762 | A | 1/1954 | Althouse, Jr. | |
| 2,666,241 | A | 1/1954 | Hall, Sr. | 24/201 |
| 2,718,266 | A | 9/1955 | Berry et al. | 166/243 |
| 2,727,576 | A | 12/1955 | Hall | 166/241 |
| 2,728,399 | A | 12/1955 | Kluck | |
| 2,738,019 | A | 3/1956 | Atkinson | 166/241 |
| 2,812,200 | A | 11/1957 | Yeargan | 287/52.09 |
| 2,824,613 | A | 2/1958 | Baker | |
| 2,828,824 | A | 4/1958 | Comstock | |
| 2,832,421 | A | 4/1958 | Baker | 166/213 |
| 2,845,128 | A | 7/1958 | Clark, Jr. | |
| 2,846,016 | A | 8/1958 | Hanes | 287/52.04 |
| 2,871,950 | A | 2/1959 | Baker | 166/241 |
| 2,877,062 | A | 3/1959 | Hall et al. | 308/4 |
| 2,898,136 | A | 8/1959 | Hall, Sr. et al. | 287/52 |
| 2,962,313 | A | 11/1960 | Conrad | 287/114 |
| 2,986,417 | A | 5/1961 | Baker | 287/52.08 |
| 2,998,074 | A | 8/1961 | Casady et al. | |
| 2,998,848 | A | 9/1961 | Wright et al. | |
| 3,065,005 | A | 11/1962 | Hall, Sr. et al. | 287/52 |
| 3,072,195 | A | 1/1963 | Kluck | 166/241 |
| 3,128,827 | A | 4/1964 | Kluck | 166/173 |
| 3,172,475 | A | 3/1965 | Moore | 166/172 |
| 3,196,951 | A | 7/1965 | Saurenman | 166/241 |
| 3,196,952 | A | 7/1965 | Solum | 166/241 |
| 3,200,884 | A | 8/1965 | Solum et al. | |
| 3,235,295 | A | 2/1966 | Solum | 287/52 |
| 3,237,696 | A | 3/1966 | Hall, Sr. | 166/241 |
| 3,289,768 | A | 12/1966 | Solum | 166/177 |
| 3,360,846 | A | 1/1968 | Schellstede et al. | 29/447 |
| 3,556,042 | A | 1/1971 | Laughlin | 166/241 |
| 3,578,084 | A | 5/1971 | Bombardieri et al. | 166/288 |
| 3,614,139 | A | 10/1971 | Harrison | 287/52 |
| 3,978,924 | A | 9/1976 | Roesner | |
| 4,011,907 | A | 3/1977 | Clay | |
| 4,021,083 | A | 5/1977 | Anderson | 308/4 A |
| 4,031,969 | A | 6/1977 | Cullen et al. | 175/65 |
| 4,042,022 | A | 8/1977 | Wills et al. | |
| 4,077,470 | A | 3/1978 | Dane | |
| 4,088,186 | A | 5/1978 | Callihan et al. | |
| 4,105,262 | A | 8/1978 | Richey | 308/4 A |
| 4,133,470 | A | 1/1979 | Trail | |
| 4,363,360 | A | 12/1982 | Richey | |
| 4,448,248 | A | 5/1984 | Schwind | |
| 4,523,640 | A | 6/1985 | Wilson et al. | |
| 4,531,582 | A | 7/1985 | Muse et al. | |
| 4,566,317 | A | 1/1986 | Shakra | 73/155 |
| 4,630,690 | A | 12/1986 | Beasley et al. | |
| 4,739,842 | A | 4/1988 | Kruger et al. | 175/61 |
| 4,787,458 | A | 11/1988 | Langer | |
| 4,794,986 | A | 1/1989 | Langer | |
| 4,880,066 | A | 11/1989 | Steiginga et al. | 175/75 |
| 4,984,633 | A | 1/1991 | Langer et al. | |
| 4,995,456 | A | 2/1991 | Cornette et al. | 166/51 |
| 5,095,981 | A | 3/1992 | Mikolajczyk | |
| 5,238,062 | A | 8/1993 | Reinholdt | |
| 5,261,488 | A | 11/1993 | Gullet et al. | |
| 5,339,896 | A | 8/1994 | Hart et al. | 166/241.1 |
| 6,209,638 | B1 | 4/2001 | Mikolajczyk | |
| 6,484,803 | B1 | 11/2002 | Gremillion | 166/241.6 |
| 6,957,704 | B2 | 10/2005 | Rogers et al. | 166/378 |

OTHER PUBLICATIONS

CaseTech's Opposition to Plaintiffs' Rule 12(b)(6) Motion to Dismiss Counterclaims, Jan. 29, 2004 [11].

Transcript of Proceedings Before the Honorable David Hittner—Scheduling Conference, Feb. 18, 2004 [20].

Plaintiffs' Motion to Clarify Statements Made by Defendant's Counsel During the Feb. 18, 2004 Scheduling Conference, Mar. 4, 2004 [21].

CaseTech's Opposition to Plaintiffs' Motion to Clarify Statements Made by Defendant's Counsel During the Feb. 18, 2004 Scheduling Conference, Mar. 29, 2004 [22].

Order, Apr. 20, 2004 [24].

Defendant's Motion for Markman Hearing and to Stay Discovery until Court Rules on Claim Construction, Jun. 18, 2004 [25].

Memorandum in Support of Defendant's Motion for Markman Hearing and to Stay Discovery until Court Rules on Claim Construction, Jun. 18, 2004 [26].

Plaintiff's Memorandum of Law in Opposition to Defendant's Motion for Markman Hearing and to Stay Discovery until Court Rules on Claim Construction, Jul. 9, 2004 [27].

Declaration of David G. Calvert (Exhibit 2).

Baker, Ron, "A Primer of Oilwell Drilling," pp. 119–146, 137 ($6^{th}$ Ed. 2001) (Exhibit 3).

American Petroleum Institute Specification for Casing, Drilling and Pipe, Spec 5A, pp. 4–5 and 34–35 (1984) (Exhibit 6).

G. Krug, Testing of Casing Under Extreme Loads, Institut of Petroleum Engineering, pp. 22, 24, 120–124 and 166–167 (1983) (Exhibit 6).

Webster's Collegiate Dictionary, $10^{th}$ Edition, pp. 303, 311, 514, 676 and 975 (1994) (Exhibit 8).

Webster's Third New International Dictionary, pp. 1001 and 1312 (1986) (Exhibit 8).

Minutes Entry, Sep. 20, 2004 [34].

Order, Nov. 12, 2004 [39].

Transcript of Markman Hearing, Sep. 20, 2004 [41].

CaseTech's Answer and First Amended and Supplemental Counterclaims, Dec. 13, 2004 [42].

Plaintiff's Rule 12(b)(6) Motion to Dismiss (1) CaseTech's Fraud and Inequitable Conduct Counterclaims, and (2) CaseTech's Unclean Hands Counterclaim, with Attachments and Proposed Order, Dec. 29, 2004 [43].

Plaintiffs' Proposed Claim Construction Order (with Attachments) Dec. 29, 2004 [44].

Weatherford International, Inc.'s and Weatherford/Lamb, Inc.'s Answers to CaseTech's Counterclaims, Jan. 7, 2004 [45].

Defendant CaseTech's Reply to Weatherford's Markman Brief, Sep. 3, 2004 [48].

Findings of Fact and Conclusions of Law Concerning Claim Construction of the '333 Patent (with Attachment) [50].

CaseTech's Opposition to Plaintiff's Rule 12(b)(6) Motion to Dismiss, Jan. 20, 2005 [51].

Plaintiffs' Reply to CaseTech's Opposition to Plaintiff's Rule 12(b)(6) Motion to Dismiss, with proposed Order, Feb. 1, 2005 [53].

Joint Repsonse to Order of Feb. 14, 2005, Feb. 18, 2005 [55].

Joint Status Report, May 17, 2005 [61].

CaseTech's Objections to Expert's Proposed Claim Construction Order, Jun. 10, 2005 [65].

Plaintiffs' Statement of Agreement with Claim Constructions of Expert V. Bryan Medlock, Jr. and Requested Minor Clarifications, Jun. 10, 2005 [66].

Defendant's Opposed Motion to Reset Hearing on Objections, with Proposed Order, Jun. 13, 2005 [68].

Plaintiff's Opposition to Defendant's Motion to Reset Hearing on Objections, Jun. 15, 2005 [70].
CaseTech's Motion for Consideration of Newly Discovered Evidence in Connection with Markman Issues (Opposed) with Exhibit 3, Jun. 29, 2005 [74].
Appendix: CaseTech's Motion for Consideration of Newly Discovered Evidence in Connection with Markman Issues (Opposed), Appendix: Information Disclosure Statement Citing 43 References pursuant to U.S. Appl. No. 10/302,641, Jun. 29, 2005 [75].
Appendix: CaseTech's Motion for Consideration of Newly Discovered Evidence in Connection with Markman Issues (Opposed), Appendix: Examiner's initialed Information Disclosure Statement Citing 43 References and file history for U.S. Appl. No. 10/302,641, Jun. 29, 2005 [76].
CaseTech's Motion for Consideration of Newly Discovered Evidence in Connection with Markman Issues (Opposed), including Exhibit 3, Jun. 30, 2005 [77–79].
Order Granting Motion for Consideration of Newly–Discovered Evidence, Jul. 1, 2005 [80].
Order Granting Motion for Consideration of Newly–Discovered Evidence, Jun. 30, 2005 [81].
Plaintiffs' Opposition to Defendant's Motion for Consideration of Newly Discovered Evidence in Connection with Markman Issues, with Continuation, Jul. 15, 2005 [82].
Defendant's Reply to Plaintiff's Opposition to Defendant's Motion for Consideration of Newly Discovered Evidence in Connection with Markman Issues, Jul. 19, 2005 [83].
Memorandum and Order, Jul. 25, 2005 [84].
Plaintiffs' Sur–Reply to Defendant's Motion for Consideration of Newly Discovered Evidence in Connection with Markman Issues, Jul. 22, 2005 [85].
Claim Construction Memorandum and Order, Aug. 12, 2005 [86].
Plaintiffs' Opposition to CaseTech's Motion for Reconsideration of the Court's Aug. 12, 2005 Claim Construction Order, Sep. 13, 2005 [88].
Memorandum and Order in Response to CaseTech's Motion for Reconsideration, Sep. 9, 2005 [89].
Defendant's Response to Plaintiffs' Motion for Leave to File their First Amended Complaint and Defendant's Cross–Motion for Leave to File its Second Amended Answer and Counterclaims, with Exhibits A and B, Dec. 5, 2005 [95].
Affidavit of Maxie Gremillion, Dec. 8, 2005 (Exhibit B) [98].
Plaintiffs' Motion to Dismiss Claims 1, 2 and 6–16 of U.S. Patent No. 5,575,333 with Prejudice, including proposed order, Dec. 7, 2005 [100].
Plaintiff's Motion to Extend the Deadline for Responding to Defendant's Motion for Summary Judgment of Invalidity, including proposed order, Dec. 13, 2005 [101].
Defendant's Response to Plaintiff's Motion to Dismiss, including proposed order, Dec. 16, 2005 [102].
Defendant's Response to Plaintiff's Motion to Extend the Deadline for Summary Judgment Response, including proposed order, Dec. 16, 2005 [103].
Plaintiffs' Response to Defendant's Sur–Reply and Supplement Concerning Motions for Leave, Dec. 16, 2005 [104].
Plaintiffs' Opposition to Defendant's Cross–Motion for Leave to File its Second Amended Answer and Counterclaims, including proposed order, Dec. 21, 2005 [106].
Plaintiffs' Emergency Motion to Delay Decisions on Pending Motions, including proposed order, Jan. 4, 2006 [108].
Supplement to Plaintiffs' Emergency Motion to Delay Decisions on Pending Motions, Jan. 5, 2006 [109].
CaseTech's Notice of Non–Opposition to the Relief Sought in Weatherford's Emergency Motion to Delay Decisions on Pending Motions, Jan. 5, 2006 [110].
Plaintiffs' Conditionally Unopposed Motion to Stay Proceedings Pending Reexamination of the Patent–in–Suit and Supporting Brief, including continuations, Jan. 9, 2006 [115].
Defendant CaseTech International, Inc.'s Reponse to Plaintiffs' Motion for Stay, including exhibits and proposed order, Jan. 30, 2006 [117].
Reply to Defendant's Response to Weatherford's Motion for Stay, including attachments, Feb. 2, 2006 [118].
Plaintiffs' Notice to the Court of the Granting of CaseTech International, Inc.'s Request for Reexamination of the Patent–in–Suit, Feb. 22, 2006 [119].
Defendant CaseTech International, Inc.'s Reponse to Plaintiffs' Notice of Reexamination, Feb. 24, 2006 [120].
Plaintiffs' Reply to CaseTech International, Inc.'s Response to Plaintiffs' Notice of Reexamination, including exhibits A and B, Feb. 27, 2006 [121].
Memorandum and Order, Mar. 8, 2006 [122].
Deposition of James Martens, Apr. 4, 2004.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–4 is confirmed.

Claims 1, 2 and 15 are cancelled.

Claims 5–11, 13 and 14 are determined to be patentable as amended.

Claims 12 and 16, dependent on an amended claim, are determined to be patentable.

New claims 17–55 are added and determined to be patentable.

5. The centralizer apparatus of claim [2] *3* wherein the exterior surface of the tubular body has a top level and the centralizer apparatus further comprising the second collar at or below the top level of the exterior surface of the tubular body, and a major portion of the spring bows receivable in the spring recesses and disposable therein at or below the top level of the exterior surface of the tubular body.

6. The centralizer apparatus of claim [2] *3* further comprising the second collar releasably emplaced around the tubular body.

7. The centralizer apparatus of claim [1] *17* further comprising the tubular body is hollow with a bore extending longitudinally therethrough.

8. The centralizer apparatus of claim [1] *17* wherein the second ends of the spring bows are secured to a second collar which is immovably secured to the tubular body.

9. The centralizer apparatus of claim [1] *17* further comprising the first collar releasably emplaced around the tubular body.

10. The centralizer apparatus of claim [1] *17* further comprising the second ends of the spring bows immovably secured to the tubular body.

11. A centralizer apparatus comprising a hollow tubular body with an exterior surface and a longitudinal bore therethrough, a first collar movably emplaced around the tubular body and movable longitudinally thereon, a plurality of spring bows, each spring bow having a first end spaced apart from a second end, each spring bow biased outwardly from the tubular body, a first groove in the exterior surface of the tubular body, the groove defined by a top side wall and a bottom side wall, and a middle wall therebetween, the first collar movably disposed in the *first* groove, the first groove top side wall and bottom side wall limiting first collar movement, the first ends of the spring bows connected to the first collar, so that upon movement of the first collar in a direction away from the second ends of the spring bows the spring bows move inwardly toward the tubular body, a second collar movably emplaced around the tubular body and movable longitudinally thereon, the second ends of the spring bows connected to the second collar, so that upon movement of the second collar away from the first collar, the spring bows move inwardly toward the tubular body, a second groove in the exterior surface of the tubular body, the second groove defined by a top side wall and a bottom side wall, and a middle wall therebetween, the second collar movably disposed in the *second* groove, [and]

the second groove top side wall and bottom side wall limiting second collar movement*, and*

*at least one spring bow recess in the exterior surface of the tubular body for receiving at least a portion of at least one spring bow.*

13. A centralizer apparatus comprising a tubular body with an exterior surface, [and]

*a first groove in the tubular body,*

*a first collar disposed in the groove, the collar movable longitudinally with respect to the tubular body,* a plurality of spring bows, each spring bow in an initial position and having a first end spaced apart from a second end, each spring bow biased outwardly from the tubular body, the first ends secured to the [tubular body] *first collar*, the second ends movable with respect to the tubular body and, the second ends spaced apart from and not interconnected with each other*, and*

*at least one spring bow recess in the exterior surface of the tubular body for receiving at least a portion of at least one spring bow.*

14. The centralizer apparatus of claim 13 further comprising the spring bows movable inwardly toward the tubular body by contact with an [upper] edge or an inner surface of a hollow tubular member, and upon movement of the centralizer apparatus through the hollow tubular member and upon exiting therefrom and cessation of contact with the hollow tubular member and release of the spring bows therefrom, the spring bows expand outwardly and move outwardly away from the tubular body back to the initial position.

*17. A centralizer apparatus comprising:*

*a tubular body with an exterior surface;*

*a first collar movably emplaced around the tubular body and movable longitudinally thereon;*

*a first groove in the exterior surface of the tubular body, the first groove defined by a top side wall, a bottom side wall, and a middle wall therebetween;*

*the first collar movably diposed in the first groove;*

*the first groove top side wall and bottom side wall limiting first collar movement;*

*a plurality of spring bows, each spring bow having a first end spaced apart from a second end, each spring bow biased outwardly from the tubular body, the first ends*

*connected to the first collar, so that upon movement of the first collar in a direction away from the second ends of the spring bows while prohibiting movement of the second ends, the first ends move with the first collar and the spring bows move inwardly toward the tubular body so as to be pullable into an adjoining opening as the tubular body moves into the opening; and*

*a spring bow recess in the exterior surface of the tubular body beneath each spring bow for receiving a portion of each spring bow as the spring bow moves inwardly.*

*18. The centralizer apparatus of claim 17, wherein the spring bows, first collar and the first groove are operatively configured such that the first collar is spaced apart from the bottom side wall when the spring bows are fully collapsed inward toward the tubular body.*

*19. The centralizer apparatus of claim 18, further comprising:*

*a second groove in the exterior surface of the tubular body;*

*a second collar disposed in the second groove, the second ends of the spring bows being conneced to the second collar.*

*20. The centralizer apparatus of claim 19, wherein the second collar is fixed in the second groove.*

*21. The centralizer apparatus of claim 19, wherein the second groove is defined by a top side wall, a bottom side wall, and a middle wall therebetween; and*

*further wherein the second collar is longitudinally movable in the second groove, the movement of the second ends being prohibited when the second collar abuts the top side wall of the second groove.*

*22. The centralizer apparatus of claim 18, wherein the tubular body comprises first and second separate tubular body sections mated to one another, the top side wall and the middle wall being configured on the first tubular body section and the bottom side wall being configured as an end portion of the second tubular body section mated to the first tubular body section.*

*23. The centralizer apparatus of claim 17, wherein the top side wall and bottom side wall of the first groove comprise projections protruding from the exterior surface of the tubular body, each of the projections having an end portion that is aligned transverse to a longitudinal axis of the tubular body; and*

*wherein the middle wall of the first groove extends transversely between the top side wall and the bottom side wall forming the spring bow recess, and longitudinally beyond the end portions of the projections, the first collar being disposed on a portion of the middle wall in the first groove, the end portions of the top side wall and bottom side wall projections limiting the first collar movement.*

*24. The centralizer apparatus of claim 23, wherein the top side wall and bottom side wall projections extend longitudinally between the first and second ends of the spring bows.*

*25. The centralizer apparatus of claim 23, wherein the tubular body comprises first and second tubular body sections mated to one another, a mating area between the first and second tubular body sections having an outer diameter substantially the same as an outer diameter of the middle wall of the first groove.*

*26. The centralizer apparatus of claim 18, wherein when fully collapsed in the spring bow recess, an exterior surface of the spring bows and first collar does not project beyond a top level of the exterior surface of the tubular body.*

*27. The centralizer apparatus of claim 18, wherein when fully collapsed in the spring bow recess, an exterior surface of the spring bows and first collar projects less than three-eighths of an inch beyond the exterior surface of the tubular body.*

*28. A centralizer apparatus comprising:*

*a tubular body with an exterior surface;*

*a first collar movably emplaced around the tubular body and movable longitudinally thereon;*

*a first circumferential groove in the exterior surface of the tubular body, the first groove defined by a top side wall, a bottom side wall, and a middle wall therebetween;*

*the first collar movably disposed in the first groove;*

*the first groove top side wall and bottom side wall limiting first collar movement;*

*a second circumferential groove in the exterior surface of the tubular body spaced apart from the first circumferential groove;*

*a second collar disposed in the second groove;*

*a plurality of spring bows, each spring bow having a first end spaced apart from a second end, each spring bow biased outwardly from the tubular body, the first ends connected to the first collar and the second ends of the spring bows connected to the second collar, so that upon movement of the first collar in a direction away from the second ends of the spring bows, the first ends move with the first collar and the spring bows move inwardly toward the tubular body; and*

*one or more longitudinal spring bow recesses in the exterior surface of the tubular body, at least one spring bow recess opening at one longitudinal end into the first circumferential groove and at the other longitudinal end into the second circumferential groove, the one or more spring bow recesses being configured to receive a portion of one or more of the plurality of spring bows as the spring bows move inwardly.*

*29. The centralizer apparatus of claim 28, wherein when fully collapsed in the one or more spring bow recesses, an exterior surface of the spring bows and first and second collars does not project beyond a top level of the exterior surface of the tubular body.*

*30. The centralizer apparatus of claim 28, wherein when fully collapsed in the one or more spring bow recesses, an exterior surface of the spring bows and first and second collars projects less than three-eighths of an inch beyond the exterior surface of the tubular body.*

*31. A centralizer apparatus comprising:*

*a tubular body with an exterior surface;*

*a collar movably emplaced around the tubular body and movable longitudinally thereon;*

*a groove in the exterior surface of the tubular body, the groove defined by a top side wall, a bottom side wall, and a middle wall therebetween;*

*the collar movably disposed in the groove;*

*the groove top side wall and bottom side wall limiting collar movement;*

*a plurality of spring bows, each spring bow having a first end spaced apart from a second end, each spring bow biased outwardly from the tubular body, the first ends connected to the collar; so that upon movement of the collar in a direction away from the second ends of the spring bows the first ends move with the collar and the spring bows move inwardly toward the tubular body;*

*the top side wall including one or more recesses adapted to receive at least a portion of one or more of the plurality of spring bows, the one or more top side wall recesses limiting the collar movement circumferentially; and*

*at least one spring bow recess in the exterior surface of the tubular body for receiving at least a further portion of the one or more spring bows, the at least one spring bow recess being axially aligned with one or more of the top side wall recesses.*

*32. The centralizer apparatus of claim 31, wherein the top side wall of the groove is formed by a plurality of projections extending from the tubular body.*

*33. The centralizer apparatus of claim 32, wherein longitudinal movement of the collar is limited by one or more of the plurality of projections extending from the tubular body.*

*34. The centralizer apparatus of claim 31, wherein the top side wall of the groove is a ring member .*

*35. The centralizer apparatus of claim 31, further comprising:*

*a second groove in the exterior surface of the tubular body; and*

*a second collar disposed in the second groove, the second collar movable longitudinally therein.*

*36. The centralizer apparatus of claim 35, wherein the second ends of the spring bows are connected to the second collar.*

*37. The centralizer apparatus of claim 35, wherein the second groove is defined by a top side wall, a bottom side wall, and a middle wall therebetween.*

*38. The centralizer apparatus of claim 37, wherein the top side wall of the second groove is formed of a plurality of projections extending from the tubular body.*

*39.The centralizer apparatus of claim 38, wherein longitudinal movement of the second collar is limited by one or more of the plurality of projections extending from the tubular body.*

*40. The centralizer apparatus of claim 38, wherein the top side wall of the first groove is formed by the plurality of projections, which projections extend longitudinally between end portions that respectively form the top side walls of the first and second grooves.*

*41. The centralizer apparatus of claim 37, wherein the top side wall of the second groove is formed by a second ring member.*

*42. The centralizer apparatus of claim 36, wherein when fully collapsed in the at least one spring bow recess, an exterior surface of the spring bows and first and second collars does not project beyond a top level of the exterior surface of the tubular body.*

*43. The centralizer apparatus of claim 36, wherein when fully collapsed in the at least one spring bow recess, an exterior surface of the spring bows and first and second collars projects less than three-eighths of an inch beyond the exterior surface of the tubular body.*

*44. A centralizer apparatus comprising:*

*a tubular body with an exterior surface, the tubular body comprising first and second separate tubular body sections mated to one another;*

*a first collar movably emplaced around the tubular body and movable longitudinally thereon;*

*a first groove in the exterior surface of the tubular body, the groove defined by a top side wall, a bottom side wall, and a middle wall therebetween, the top side wall and the middle wall being configured on the first tubular body section and the bottom side wall being configured as an end portion of the second tubular body section mated to the first tubular body section;*

*a first collar movably disposed in the groove;*

*the first groove top side wall and bottom side wall limiting first collar movement;*

*a plurality of spring bows, each spring bow having a first end spaced apart from a second end, each spring bow biased outwardly from the tubular body, the first ends connected to the first collar, so that upon movement of the first collar in a direction away from the second ends of the spring bows the first ends move with the first collar and the spring bows move inwardly toward the tubular body; and*

*one or more spring bow recesses in the exterior surface of the tubular body capable of receiving at least a portion of one or more of the plurality of spring bows.*

*45. The centralizer apparatus of claim 44, wherein the top side wall of the groove comprises a plurality of projections extending from the first tubular body section.*

*46. The centralizer apparatus of claim 45, wherein the longitudinal movement of the collar is limited by one or more of the plurality of projections extending from the first tubular body section.*

*47. The centralizer apparatus of claim 44, wherein the top side wall of the groove comprises a ring member.*

*48. The centralizer apparatus of claim 44, further comprising:*

*a second groove in the exterior surface of the tubular body;*

*a second collar disposed in the second groove, the second collar movable longitudinally therein; and*

*the second ends of the spring bows connected to the second collar, so that upon movement of the second collar in a direction away from the first ends of the spring bows the second ends of the spring bows move with the second collar and the spring bows move inwardly toward the tubular body.*

*49. The centralizer apparatus of claim 48, wherein when fully collapsed in the one or more spring bow recesses, an exterior surface of the spring bows and first and second collars does not project beyond a top level of the exterior surface of the tubular body.*

*50. The centralizer apparatus of claim 48, wherein when fully collapsed in the one or more spring bow recesses, an exterior surface of the spring bows and first and second collars projects less than three-eighths of an inch beyond the exterior surface of the tubular body.*

*51. A centralizer apparatus comprising:*

*a tubular body with an exterior surface;*

*a first collar movably emplaced around the tubular body and movable longitudinally thereon;*

*one or more grooves in the exterior surface of the tubular body, at least one groove defined by a top side wall, a bottom side wall, and a middle wall therebetween;*

*the top side wall and bottom side wall of the at least one groove comprising projections protruding from the exterior surface of the tubular body, each of the projections having an end portion that is aligned transverse to the longitudinal axis of the tubular body;*

*the middle wall of the at least one groove extending transversely between the top side wall and the bottom side wall, and longitudinally beyond the end portions of the projections;*

*the first collar movably disposed on a portion of the middle wall in the at least one groove;*

*the end portions of the at least one groove top side wall and bottom side wall limiting first collar movement;*

*a plurality of spring bows, each spring bow having a first end spaced apart from a second end, each spring bow biased outwardly from the tubular body, the first ends*

*connected to the first collar, so that upon movement of the first collar in a direction away from the second ends of the spring bows the first ends move with the first collar and the spring bows move inwardly toward the tubular body; and*

*one or more spring bow recesses comprising at least a portion of the middle wall of the one or more grooves, the spring bow recesses capable of receiving at least a portion of one or more of the plurality of spring bows.*

*52. A centralizer apparatus comprising:*

*a tubular body with an exterior surface, the tubular body comprising first and second separate tubular body sections mated to one another;*

*a first collar movably emplaced around the tubular body and movable longitudinally thereon;*

*one or more grooves in the exterior surface of the tubular body, at least one groove defined by a top side wall, a bottom side wall, and a middle wall therebetween;*

*the top side wall and bottom side wall of the at least one groove comprising projections protruding from the exterior surface of the tubular body, each of the projections having an end portion that is aligned transverse to the longitudinal axis of the tubular body;*

*the middle wall of the at least one groove extending over the exterior surface of the tubular body transversely between the top side wall and the bottom side wall, and longitudinally beyond the end portions of the projections;*

*the first collar movably disposed on a portion of the middle wall in the at least one groove;*

*the end portions of the at least one groove top side wall and bottom side wall limiting first collar movement;*

*a plurality of spring bows, each spring bow having a first end spaced apart from a second end, each spring bow biased outwardly from the tubular body, the first ends connected to the first collar, so that upon movement of the first collar in a direction away from the second ends of the spring bows the first ends move with the first collar and the spring bows move inwardly toward the tubular body;*

*a mating area between the first and second tubular body sections having an outer diameter substantially the same as an outer diameter of the middle wall of the at least one groove; and*

*one or more spring bow recesses comprising at least a portion of the middle wall of the one or more grooves, the spring bow recesses capable of receiving at least a portion of one or more of the plurality of spring bows.*

*53. A centralizer apparatus comprising:*

*a tubular body with an exterior surface;*

*a first collar movably emplaced around the tubular body and movable longitudinally thereon;*

*a second collar emplaced around the tubular body spaced apart from the first collar;*

*one or more grooves in the exterior surface of the tubular body, at least one groove defined by a top side wall, a bottom side wall, and a middle wall therebetween;*

*the top side wall and bottom side wall of the at least one groove comprising projections protruding from the exterior surface of the tubular body, each of the projections having an end portion that is aligned transverse to the longitudinal axis of the tubular body;*

*the middle wall of the at least one groove extending transversely between the top side wall and the bottom side wall, and longitudinally beyond the end portions of the projections;*

*at least the first collar movably disposed on a portion of the middle wall in the at least one groove;*

*the end portions of the at least one groove top side wall and bottom side wall limiting first collar movement;*

*a plurality of spring bows, each spring bow having a first end spaced apart from a second end, each spring bow biased outwardly from the tubular body, the first ends connected to the first collar, so that upon movement of the first collar in a direction away from the second ends of the spring bows the first ends move with the first collar and the spring bows move inwardly toward the tubular body; and*

*one or more spring bow recesses comprising at least a portion of the middle wall of the one or more grooves, the spring bow recesses capable of receiving at least a portion of one or more of the plurality of spring bows.*

*54. A centralizer apparatus comprising:*

*a tubular body with an exterior surface, the tubular body comprising first and second separate tubular body sections mated to one another;*

*a first collar movably emplaced around the tubular body and movable longitudinally thereon;*

*one or more grooves in the exterior surface of the tubular body, at least one groove defined by a top side wall, a bottom side wall, and a middle wall therebetween;*

*the top side wall and bottom side wall of the at least one groove comprising projections protruding from the exterior surface of the tubular body, each of the projections having an end portion that is aligned transverse to the longitudinal axis of the tubular body,*

*the middle wall of the at least one groove extending transversely between the top side wall and the bottom side wall, and longitudinally beyond the end portions of the projections;*

*the first collar movably disposed on a portion of the middle wall in the at least one groove;*

*the end portions of the at least one groove top side wall and bottom side wall limiting first collar movement;*

*a plurality of spring bows, each spring bow having a first end spaced apart from a second end, each spring bow biased outwardly from the tubular body, the first ends connected to the first collar, so that upon movement of the first collar in a direction away from the second ends of the spring bows the first ends move with the first collar and the spring bows move inwardly toward the tubular body;*

*a second collar emplaced around the tubular body, the second ends of the spring bows being connected to the second collar;*

*one or more spring bow recesses comprising at least a portion of the middle wall of the one or more grooves, the spring bow recesses capable of receiving at least a portion of one or more of the plurality of spring bows; and*

*a mating area between the first and second tubular body sections having an outer diameter substantially the same as an outer diameter of the middle wall of the at least one groove.*

*55. A centralizer apparatus comprising:*

*a tubular body with an exterior surface;*

*a first collar movably emplaced around the tubular body and movable longitudinally thereon;*

*a first groove in the exterior surface of the tubular body, the first groove defined by a top side wall, a bottom side wall, and a middle wall therebetween;*

*the first collar movably disposed in the first groove;*

*the first groove top side wall and bottom side wall limiting first collar movement;*

*a second groove in the exterior surface of the tubular body, the second groove having a top and a bottom side wall;*

*a second collar disposed in the second groove;*

*a plurality of spring bows, each spring bow having a first end spaced apart from a second end, each spring bow biased outwardly from the tubular body, the first ends connected to the first collar and the second ends of the spring bows connected to the second collar, so that upon movement of the first collar in a direction away from the second ends of the spring bows while prohibiting movement of the second ends, the first ends move with the first collar and the spring bows move inwardly toward the tubular body so as to be pullable into an adjoining opening as the tubular body moves into the opening;*

*one or more spring bow recesses in the exterior surface of the tubular body for receiving a portion of one or more of the spring bows as the spring bows move inwardly; and*

*wherein the first and second grooves, the first and second collars, and the plurality of spring bows, are operatively configured such that, when the spring bows are fully collapsed within the recess and one of the first and second collars abuts its respective top side wall, the other one of the first and second collars is spaced apart from its respective bottom side wall.*

* * * * *